United States Patent [19]

Minami

[11] 4,368,562

[45] Jan. 18, 1983

[54] ORNAMENTAL ATTACHMENT FOR SLIDE FASTENER SLIDERS

[75] Inventor: Hiroo Minami, Uozu, Japan

[73] Assignee: Yoshida Kogyo K. K., Tokyo, Japan

[21] Appl. No.: 227,525

[22] Filed: Jan. 22, 1981

[30] Foreign Application Priority Data

Jan. 31, 1980 [JP] Japan ..... 55-10726[U]
Jun. 24, 1980 [JP] Japan ..... 55-88393[U]

[51] Int. Cl.[3] ..... A44B 19/26
[52] U.S. Cl. ..... 24/205.11 L; 24/205.15 H
[58] Field of Search ..... 24/205.15 H, 205.11 L, 24/205.11 R

[56] References Cited

U.S. PATENT DOCUMENTS 4,193,172 9/1980 Kanzaka ..... 24/205.15 H

FOREIGN PATENT DOCUMENTS 2907232 9/1979 Fed. Rep. of Germany ... 24/205.11 L
7929167 1/1980 Fed. Rep. of Germany ... 24/205.11 L
WO80/02494 11/1980 PCT Int'l Appl. ..... 24/205.15 H

*Primary Examiner*—Paul J. Hirsch
*Attorney, Agent, or Firm*—Hill, Van Santen, Steadman, Chiara & Simpson

[57] ABSTRACT

An ornamental attachment for a slide fastener slider includes a body having a slot receptive of a slider pull tab having a lateral projection, the slot being defined between a plate and a pair of cantilevered resilient flaps confronting the plate and having distal edges directed toward each other. The plate or the flaps have a cam projecting into the slot. The body also has a hole adjacent to the flaps and communicates with the slot. When the pull tab is inserted into the slot, the pull tab is caused by the cam to displace or flex the flaps against the resiliency thereof until the lateral projection of the pull tab is snapped into the hole, whereupon the flaps spring back into a position in which the lateral projection is locked in the hole by the adjacent ends of the flaps.

8 Claims, 19 Drawing Figures

ORNAMENTAL ATTACHMENT FOR SLIDE FASTENER SLIDERS

BACKGROUND OF THE INVENTION

1. Field of the Invention

The present invention relates to an ornamental attachment mountable on the pull tab of a slide fastener slider.

2. Prior Art

A variety of ornamental attachments have been known which are attachable to slider pull tabs to make the latter look attractive. One prevalent form of such ornamental attachment is disclosed in U.S. Pat. No. 4,193,172, patented Mar. 18, 1980 and includes a decorative body of resilient material having a slot into which the pull tab is forcibly inserted. The ornamental attachment includes a projection which extends into the slot and which is locatable in a hole in the inserted pull tab to lock the attachment and the pull tab together. The known ornamental attachment, however, is disadvantageous in that some muscular effort needs to be spent in assembling the attachment onto the pull tab, the attachment can not fit over pull tabs of different thicknesses, and the locking projection of the attachment tends to wear or flex when subjected to severe stresses exerted each time the slider is manipulated on a slide fastener chain. The wear or flexing of the projection results in the risk of allowing the ornamental attachment to get disassembled from the pull tab.

SUMMARY OF THE INVENTION

An ornamental attachment for a slide fastener slider has a pair of cantilevered resilient flaps which together with a plate define a slot receptive of a pull tab of the slider. The plate or flaps have a cam which is engageable with the pull tab which is inserted into the slot, for causing the pull tab to displace or flex the flaps against the resiliency thereof until a lateral projection on the pull tab is snapped into a hole adjacent to the flaps. When the lateral projection is placed in the hole, the flaps spring back to lock the pull tab in position. With the springy flaps, the ornamental attachment can be attached to slider pull tabs of varying thicknesses.

It is an object of the present invention to provide an ornamental attachment for slide fastener sliders which can be attached to slider pull tabs easily in 1-step operation.

Another object of the present invention is to provide an ornamental attachment which, when attached to a slider pull tab, is retained reliably and stably thereon against wobbling.

Still another object of the present invention is to provide an ornamental attachment for slide fastener sliders which is attachable to slider pull tabs having different thicknesses.

Many other advantages, features and additional objects of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 1:
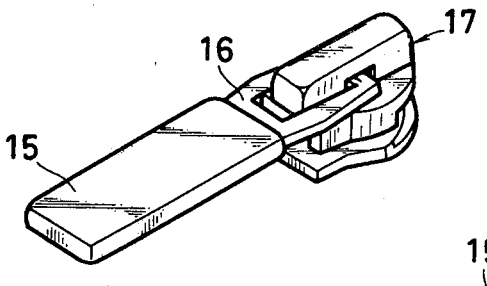
FIG. 1 is a perspective view of an ornamental attachment according to the present invention, as attached to a slide fastener slider.
Figure 2:
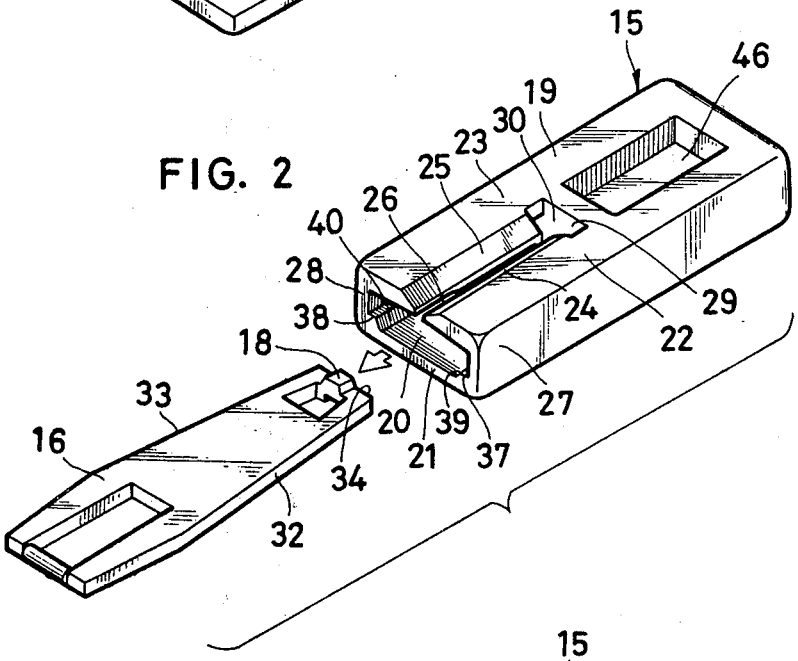
FIG. 2 is an enlarged perspective view of the ornamental attachment as it is about to fit over a slider pull tab.

As shown in FIG. 1, an ornamental attachment 15 according to the present invention is fitted over a pull tab 16 of a slide fastener slider 17, the pull tab 16 having a centrally located lateral projection 18 (FIG. 2) at a distal end 34 thereof. The lateral projection 18 doubles as an aid in assembling the slider 17 and as either a gripping aid when the slider 17 is used alone without the ornamental attachment 15 or a locking aid in combination with the ornamental attachment 15.

The ornamental attachment 15 is preferably made of synthetic resin such as nylon, but may be made of other resilient material. The ornamental attachment 15 comprises an elongate body 19 having a slot 20 (see also FIGS. 5 and 8) therein extending longitudinally from an end of the body 19 to a point substantially centrally of the body 19. Although not shown, the body 19 may be painted or engraved with a decorative pattern as desired. The slot 20 is defined by a bottom plate 21, a pair of cantilevered flaps 22,23 spaced in confronting relation from the bottom plate 21 and having a pair of distal edges 24,25, respectively, which are directed toward each other and jointly define a longitudinal slit 26 therebetween, a pair of sidewalls 27,28 extending between the bottom plate 21 and the flaps 22,23 and supporting the latter, and an end wall 29 located substantially centrally of the body 19. The body 19 also has a hole 30 defined between ends of the flaps 22,23 and the end wall 29 and communicating with the slot 20. The slot 20 has an opening 31 (FIG. 4) positioned at one end of the body 19 in longitudinally spaced relation to the end wall 29.

The slider pull tab 16 includes a pair of oppositely disposed side edges 32,33 that are convergent or tapered toward the distal end 34 of the pull tab 16.

Figure 3:
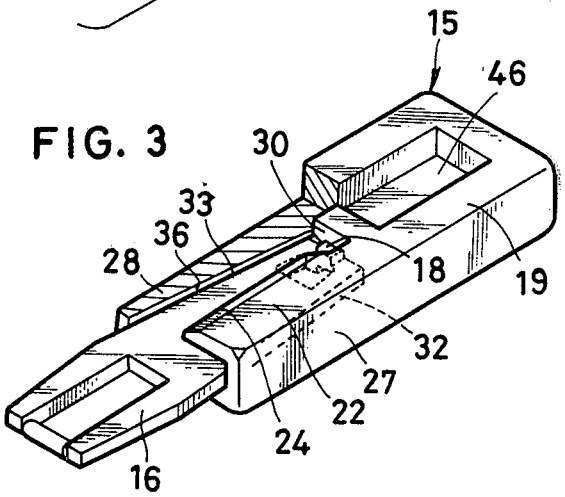
FIG. 3 is an enlarged perspective view, partly cut away, of the ornamental attachment as it fits over the slider pull tab.
Figure 4:
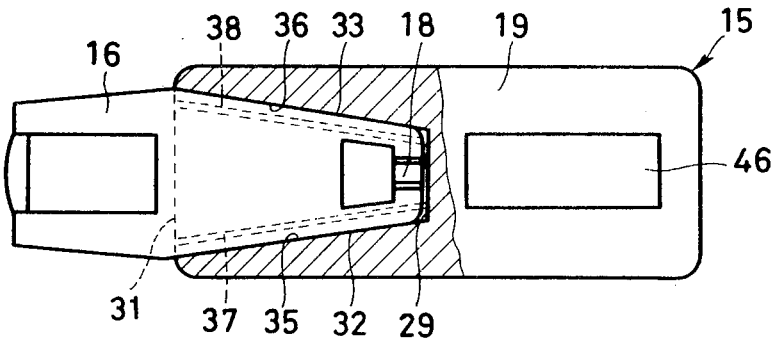
FIG. 4 is a plan view, partly cut away, of the ornamental attachment in which the slider pull tab is inserted.

As best illustrated in FIGS. 3 and 4, the sidewalls 27,28 include a pair of lateral guide surfaces 35,36 which face each other in the slot 20 and are divergent toward the open end 31 of the slot 20 in complemental relation to the pull tab 16. A pair of shoulders 37,38 is disposed on the bottom plate 21 and they extend along the lateral guide surfaces 35,36 of the sidewalls 27,28, respectively, from the open end 31 all the way to the end wall 29. The shoulders 37,38 have a pair of slants 39,40, respectively, extending therealong and inclined downwardly toward an upper surface 41 of the bottom plate 21.

The flaps 22,23 have a pair of cam ridges 42,43 (FIGS. 8–10) projecting into the slot 20 toward the bottom plate 21 and extending along the distal edges 24,25 of the flaps 22,23, respectively. Each ridge 42,43 projects generally progressively into the slot 20 in a direction from the open end 31 to the end wall 29, and includes an intermediate step 44 (best shown in FIGS. 5–7) and a nose 45 located adjacent to the hole 30 and projecting further toward the bottom plate 21 beyond the intermediate step 44, the step 44 blending with the nose 45 to provide a gradually sloped transition surface. The ridges 42,43 are substantially centrally located widthwise of the body 19 at equidistant locations from the sidewalls 27,28, respectively, such that the lateral projection 18 of the pull tab 16 will be aligned with the ridges 42,43 when the pull tab 16 is inserted into the slot 20.

The body 19 of the ornamental attachment 15 has a recess 46 which assists the operator in gripping the ornamental attachment 15 firmly when the slider 17 is manipulated.

Figure 5:
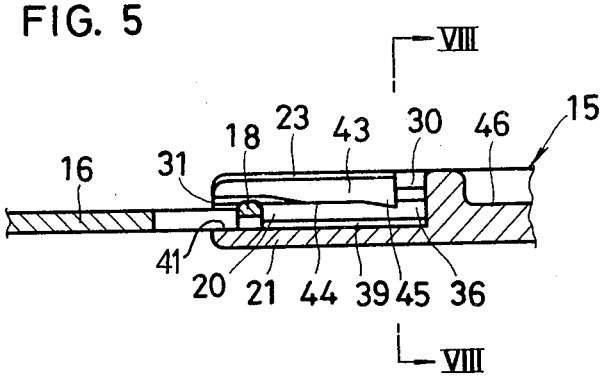
FIGS. 5, 6 and 7 are vertical cross-sectional views showing progressive stages of fitting the ornamental attachment over the pull tab.
Figure 6:
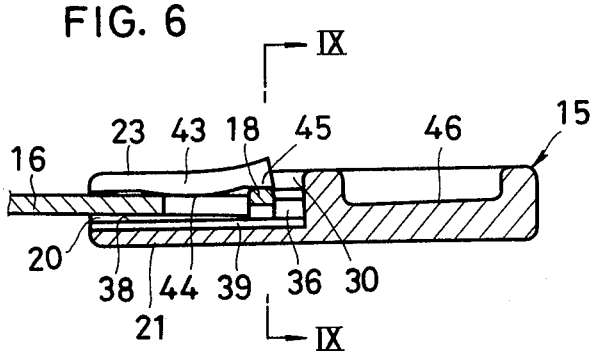
Figure 7:
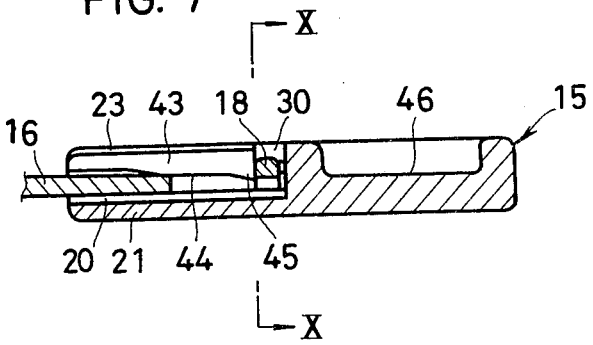
Figure 8:
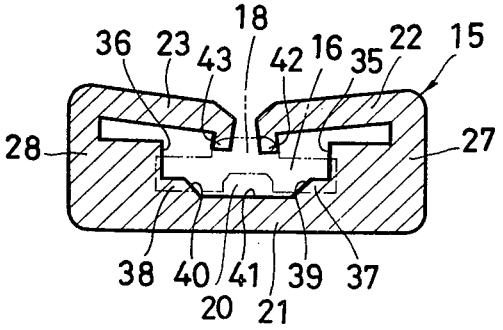
FIGS. 8, 9 and 10 are enlarged cross-sectional views taken along lines VIII—VIII, IX—IX, and X—X of FIGS. 5, 6 and 7.
Figure 9:
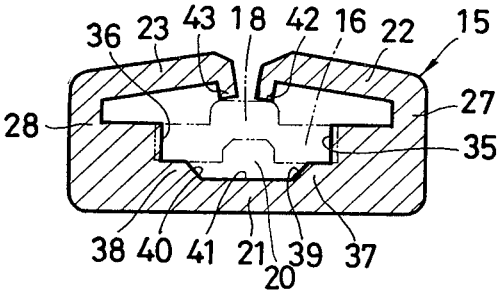
Figure 10:
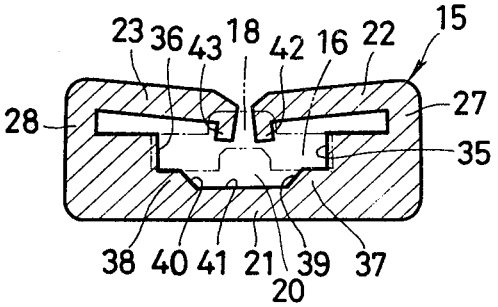

The ornamental attachment 15 will be attached to the pull tab 16 as follows: The pull tab 16 over which the ornamental attachment 15 is to be fitted is formed by pressing and punching a sheet of metal, and has a maximum thickness (at the projection 18) that should preferably be substantially equal to or may be slightly smaller or greater than the height of the opening 31 of the slot 20 in the attachment body 19. The ornamental attachment 15 is moved toward the pull tab 16 to allow the latter to be progressively inserted into the slot 20 with the projection 18 foremost as shown in FIG. 5. Right after the pull tab 16 has started fitting into the slot 20, the pull tab 16 is placed on the upper surface 41 of the bottom plate 21 (FIGS. 5 and 8). As the ornamental attachment 15 continues to move forward, the side edges 32,33 of the pull tab 16 start riding onto the slants 39,40. Continued advancing movement of the ornamental attachment 15 causes the pull tab 16 to ride completely on the shoulders 37,38 along the slants 39,40, respectively, whereupon the projection 18 of the pull tab 16 engages and pushes the intermediate steps 44 of the ridges 42, 43 upwardly, causing the flaps 22,23 to start being forced upwardly away from the bottom plate 21. As the ornamental attachment 15 is advanced further, the noses 45 of the ridges 42,43 are engaged by the projection 18 of the pull tab 16 and displaced upwardly thereby as illustrated in FIGS. 6 and 9. When the ridge noses 45 move past the projection 18, the resilient flaps 22,23 spring back toward the bottom plate 21, whereupon the projection 18 is snapped into the hole 30, as shown in FIG. 7.

The pull tab 16 thus fitted and locked in the slot 20 is now pressed by the flaps 22,23 down against the shoulders 37,38, and the side edges 32,33 of the pull tab 16 are held intimately against the guide surfaces 35,36 of the sidewalls 27,28, respectively. Thus, the ornamental attachment 15 is stably retained on the pull tab 16 against wobbling movement. The projection 18 of the pull tab 16 is trapped and engaged by the ends of the flaps 22,23 which partly define the hole 30, against the ornamental attachment's being forcibly detached from the pull tab 16, because forces tending to pull the ornamental attachment 15 off the pull tab 16 as when manipulating the slider 17 are borne endwise by the flaps 22,23. The flaps 22,23 have a mechanical strength sufficiently large lengthwise to prevent damages thereto due to stresses applied during or fatigue resulting from frequent usage of the slider 17. Furthermore, the ornamental attachment 15 can easily be attached to the pull tab 16 simply by fitting the attachment 15 over the pull tab 16 in a single stroke.

Figure 11:
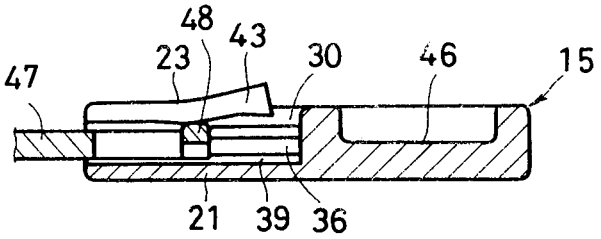
FIG. 11, appearing with FIG. 4, is a vertical cross-sectional view of the ornamental attachment as it is fitting over a thicker slider pull tab.
Figure 12:
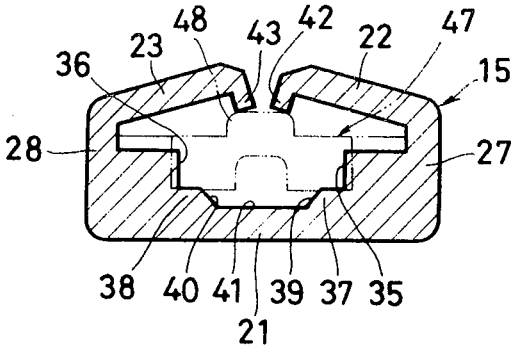
FIG. 12, appearing with FIG. 4, is an enlarged cross-sectional view of the ornamental attachment in which the pull tab shown in FIG. 11 is inserted.

FIGS. 11 and 12 show the manner in which the ornamental attachment 15 is attached to a slider pull tab 47 which is formed by die-casting and is relatively thick, the pull tab 47 having a lateral projection at a distal end thereof. The ornamental attachment 15 can be fitted over the pull tab 47 in substantially the same way as when it is attached to the pull tab 16, except that the flaps 22,23 will be forced to flex by a greater degree when the projection 48 engages the ridges 42,43 as shown in FIG. 12.

Accordingly, the ornamental attachment 15 can be attached to slider pull tabs having varying thicknesses.

Figure 13:
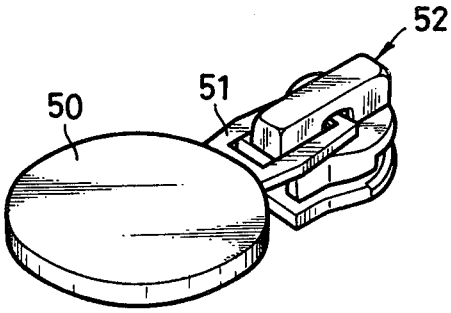
FIG. 13 is a perspective view of an ornamental attachment according to another embodiment, as attached to a slide fastener slider.
Figure 14:
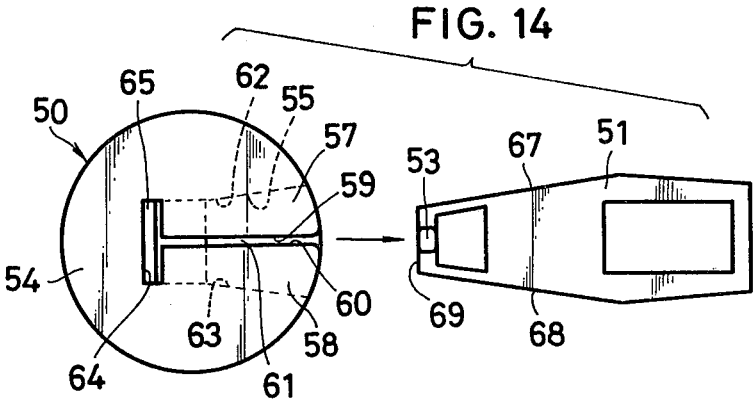
FIG. 14 is a plan view of the ornamental attachment shown in FIG. 13 as it is about to fit over a slider pull tab.
Figure 18:
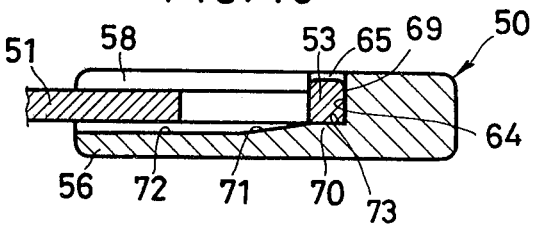

As shown in FIG. 13, an ornamental attachment 50 according to another embodiment is circular in shape and attached to a pull tab 51 of a slide fastener slider 52, the pull tab 51 having a lateral projection 53 (FIGS. 14 and 18).

Figure 15:
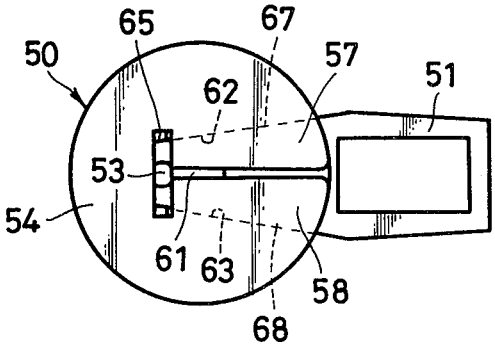
FIG. 15 is a plan view of the ornamental attachment of FIG. 13 as fitted over the slider pull tab.
Figure 16:
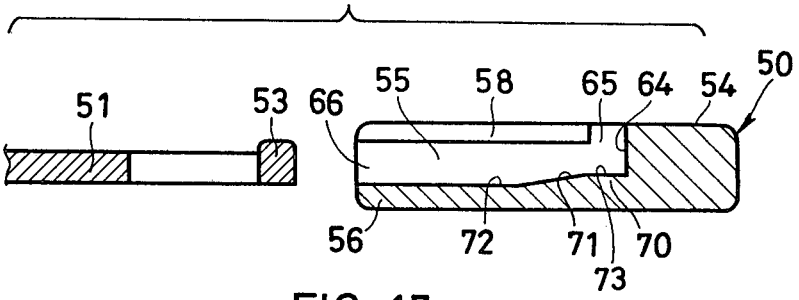
FIGS. 16, 17 and 18 are cross-sectional views showing progressive stages of fitting the ornamental attachment of FIG. 14 over the pull tab.

The ornamental attachment 50 has a circular disc-shaped body 54 (FIG. 14) including a slot 55 as illustrated in FIG. 16. The slot 55 is defined by a bottom plate 56, a pair of cantilevered resilient flaps 57,58 (FIGS. 14 and 15) having a pair of distal edges 59,60, respectively, with a slit 61 therebetween, a pair of side surfaces 62,63 confronting each other, and an end wall 64. The attachment body 54 has a rectangular hole 65 extending across the slit 61 and communicating with the slot 55. The slot 55 has an open end 66 remote from the end wall 64 as shown in FIG. 16.

The pull tab 51 has a pair of opposite side edges 67,68 which are convergent or tapered toward a distal end 69 of the pull tab 51 at which the projection 53 is located. The side surfaces 62,63 are divergent toward the open end 66 of the slot 55 for complemental fitting with the side edges 67,68, respectively.

As best illustrated in FIG. 16, a cam land 70 is disposed on the bottom plate 56 and extends across the slot 55. The land 70 includes a slant 71 inclined progressively downwardly toward the open end 66 of the slot 55 and blending with an upper surface 72 of the bottom plate 56. The land 70 also includes a support surface 73 disposed below the hole 65 in substantially coextensive relation therewith.

Figure 17:
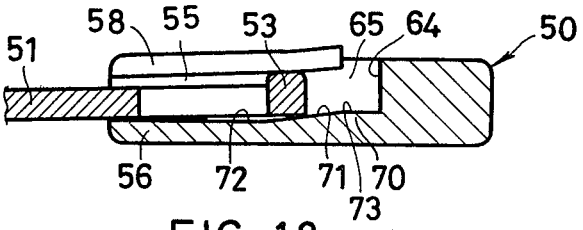

When the ornamental attachment 50 and the pull tab 51 are brought together to insert the latter into the slot 55, the pull tab 51 is first placed on the bottom plate 56. Continued movement of the pull tab 51 into the slot 55 causes the pull tab 51 to start riding onto the slant 71, and at the same time causes the projection 53 to start pushing the flaps 57,58 upwardly away from the bottom plate 56, as shown in FIG. 17. When the pull tab 51 is further inserted so that the distal end 69 abuts against the end wall 64, the projection 53 clears the flaps 57,58 and is snapped into the hole 65, and simultaneously the flaps 57,58 spring back downwardly due to their own resiliency, as shown in FIG. 18. Thus, the pull tab 51 is retained lockingly in the ornamental attachment 50 once they are assembled together.

Figure 19:
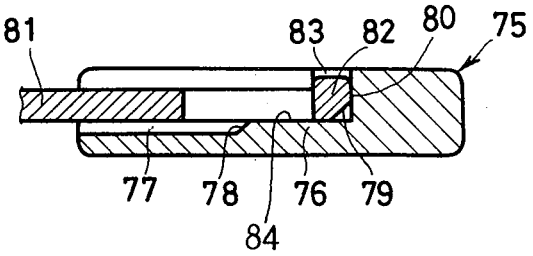
FIG. 19 is a cross-sectional view of a modified ornamental attachment.

FIG. 19 illustrates a modified ornamental attachment 75 including a land 76 in a slot 77 receptive of a slider pull tab 81. The land 76 includes a slant 78 which is steeper than the slant 71 (FIGS. 16–18) and which is engageable with a bevel 79 at a distal end 80 of the pull tab 81 at which there is a lateral projection 82. When the pull tab 81 is inserted into the slot 77, the bevel 79 abuts against the slant 78 and slides thereover onto the land 76, and the pull tab 81 becomes locked in the ornamental attachment 75 when the projection 82 is snapped into a hole 83. With the modified ornamental attachment 75, the land 76 can provide a relatively large upper support surface 84 for contact with the pull tab 81 so that the pull tab 81 as inserted can be more stably retained in the ornamental attachment 75.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. An ornamental attachment for a slide fastener slider including a pull tab having a lateral projection, comprising:

(a) a body including a plate and a pair of cantilevered resilient flaps confronting said plate and having distal edges directed toward each other;

(b) said plate and pair of cantilevered flaps jointly defining a slot receptive of the pull tab;

(c) said body having a hole communicating with said slot and disposed adjacent to said flaps; and (d) at least one cam projecting into said slot for causing the pull tab on engagement therewith to displace at least one of said flaps against the resiliency thereof when the pull tab is inserted into said slot, until the lateral projection of the pull tab becomes snapped into said hole.

2. An ornamental attachment according to claim 1, said slot having open and closed ends, said cam projecting progressively into said slot in a direction from said open end to said closed end.

3. An ornamental attachment according to claim 1, said cam terminating at said hole.

4. An ornamental attachment according to claim 1, said cam comprising a pair of parallel ridges disposed on and extending along said distal edges, respectively, of the flaps toward said plate.

5. An ornamental attachment according to claim 4, each of said pair of ridges having a cam surface inclined with respect to said plate.

6. An ornamental attachment according to claim 1, said body including a pair of spaced sidewalls laterally defining said slot therebetween and supporting said cantilevered flaps, respectively, said sidewalls having a pair of confronting guide surfaces within said slot for guiding the slider when the latter is inserted into said slot.

7. An ornamental attachment according to claim 1, said cam comprising a land disposed on said plate within said slot and having a cam surface inclined with respect to said plate.

8. An ornamental attachment according to claim 7, said land extending across said slot and having a support surface disposed at said hole in substantially coextensive relation therewith.

* * * * *